US007232357B2

(12) United States Patent
Chen

(10) Patent No.: US 7,232,357 B2
(45) Date of Patent: Jun. 19, 2007

(54) STRUCTURE OF HULA-HOOP

(76) Inventor: Kun Yueh Chen, No. 18, Alley 7, Lane 39, Kuo-Tai Street, Panchiao, Taipei (TW)

( * ) Notice: Subject to any disclaimer, the term of this patent is extended or adjusted under 35 U.S.C. 154(b) by 191 days.

(21) Appl. No.: 11/105,050

(22) Filed: Apr. 12, 2005

(65) Prior Publication Data

US 2006/0172657 A1 Aug. 3, 2006

(51) Int. Cl.
*A63H 33/02* (2006.01)

(52) U.S. Cl. ..... 446/236; 446/28; 482/10; 482/131

(58) Field of Classification Search ..... 446/236, 446/219, 239, 242, 247, 26, 28; 482/131, 482/10, 148, 146; 434/236; 601/132
See application file for complete search history.

(56) References Cited

U.S. PATENT DOCUMENTS

| | | | | |
|---|---|---|---|---|
| 3,006,645 | A * | 10/1961 | Frazier | 482/43 |
| 4,380,885 | A * | 4/1983 | Komagata | 446/236 |
| 4,915,666 | A * | 4/1990 | Maleyko | 446/242 |
| 6,217,482 | B1 * | 4/2001 | Yoo et al. | 482/10 |
| 6,319,086 | B1 * | 11/2001 | Shen | 446/236 |
| 6,440,047 | B1 * | 8/2002 | Huang | 482/148 |
| 6,533,635 | B1 * | 3/2003 | Chern | 446/236 |

* cited by examiner

*Primary Examiner*—Nini F. Legesse
(74) *Attorney, Agent, or Firm*—Pro-Techtor Int'l Services

(57) ABSTRACT

A hula-hoop is disclosed to include a hula-hoop body that is formed of two symmetrical halves that can be collapsed when not in use or locked in shape when in use, a plurality of sliding members respectively coupled to and movable along the periphery of the hula-hoop body, and weights selectively mounted in the sliding members.

9 Claims, 16 Drawing Sheets

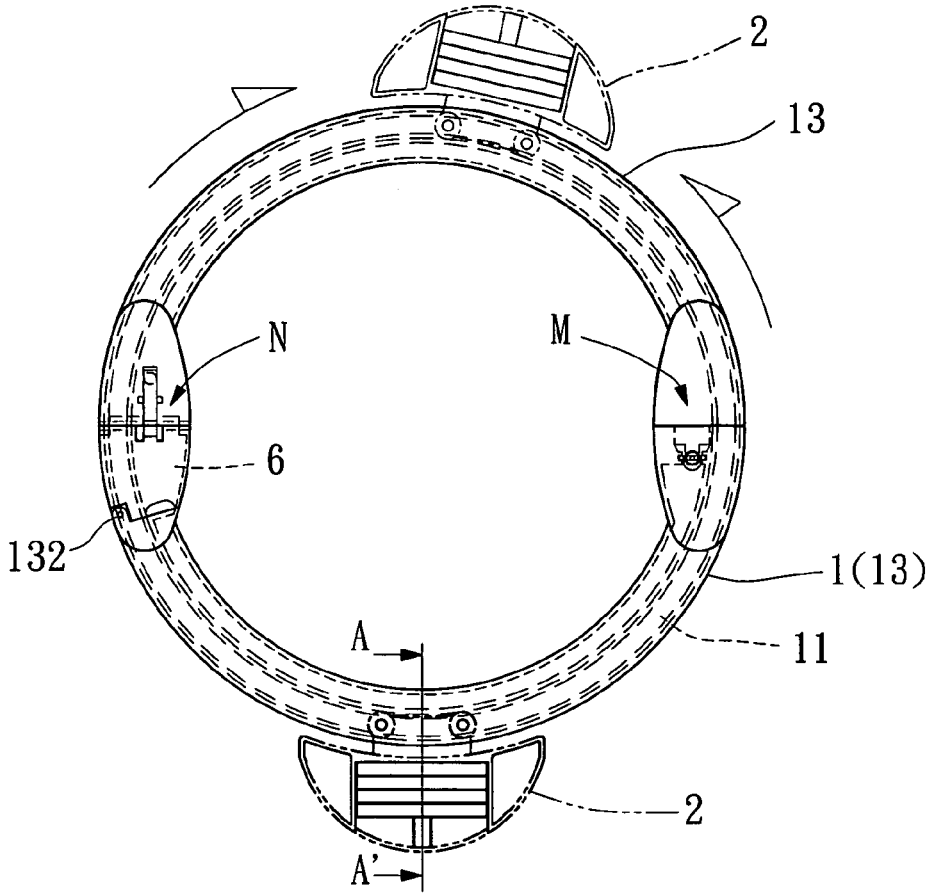
FIG. 3
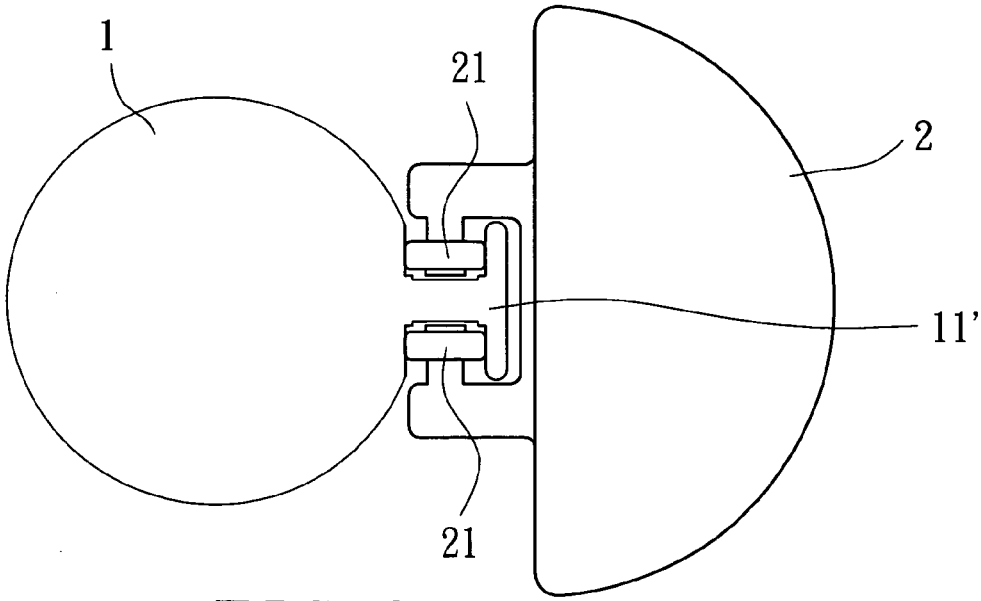
FIG. 3-A

A-A'

STRUCTURE OF HULA-HOOP

BACKGROUND OF THE INVENTION

1. Field of the Invention

The present invention relates to hula-hoops and more particularly, to such a hula-hoop, which has a plurality of sliding members slidably coupled to the periphery thereof for carrying weights.

2. Description of the Related Art

A conventional hula-hoop, as shown in FIG. 1, is a plaything consisting of a tubular plastic hoop 10 for swinging around the hips. Further, different designs of hula-hoops with massaging, sound and/or lighting effects have been disclosed. For example, the hula-hoop shown in FIG. 2 comprises a hula-hoop body 20 and a plurality of massaging members 30 rotatably mounted on the hula-hoop body 20 that massage the user's waist (or hips) when the hula-hoop body 20 is swinging around the user's waist (or hips). Hula-hoops with a massaging function are seen in U.S. Pat. Nos. 5,997,449; 6,309,273; 6,319,086; 6,533,635. Hula-hoops with sound and/or lighting effects are seen in U.S. Pat. Nos. 6,036,573; 6,497,603. Because the aforesaid hula-hoops that provide massaging, sound and or lighting effects have appeared on the market for a certain period of time, they are not fresh to consumers, having little attraction for people.

SUMMARY OF THE INVENTION

The present invention has been accomplished under the circumstances in view. It is one object of the present invention to provide a hula-hoop, which can adjustably be equipped with weights that can be moved along the periphery of the hula-hoop thereof. It is another object of the present invention to provide a hula-hoop, which is folding collapsible. According to one aspect of the present invention, the hula-hoop comprises a hula-hoop body for swinging around the body of a person, the hula-hoop body having a sliding way, for example, a sliding groove or rail extending around the periphery thereof, and at least one sliding member coupled to the hula-hoop body and movable along the sliding way. According to another aspect of the present invention, a plurality of support members are equiangularly spaced around the inner diameter of the hula-hoop body for supporting the hula-hoop around the body of a person. According to still another aspect of the present invention, the hula-hoop body is comprised of two semicircular halves. The two semicircular halves each have a first end pivotally coupled to each other and a second end detachably connected to each other through a quick-release lock.

BRIEF DESCRIPTION OF THE DRAWINGS

FIG. 3 is a plain view of a hula-hoop according to one embodiment of the present invention.

FIG. 3-A is a sectional view of an alternate form of the present invention, showing the sliding member coupled to the rail around the periphery of the hula-hoop body.

DETAILED DESCRIPTION OF THE PREFERRED EMBODIMENT

Figure 1:
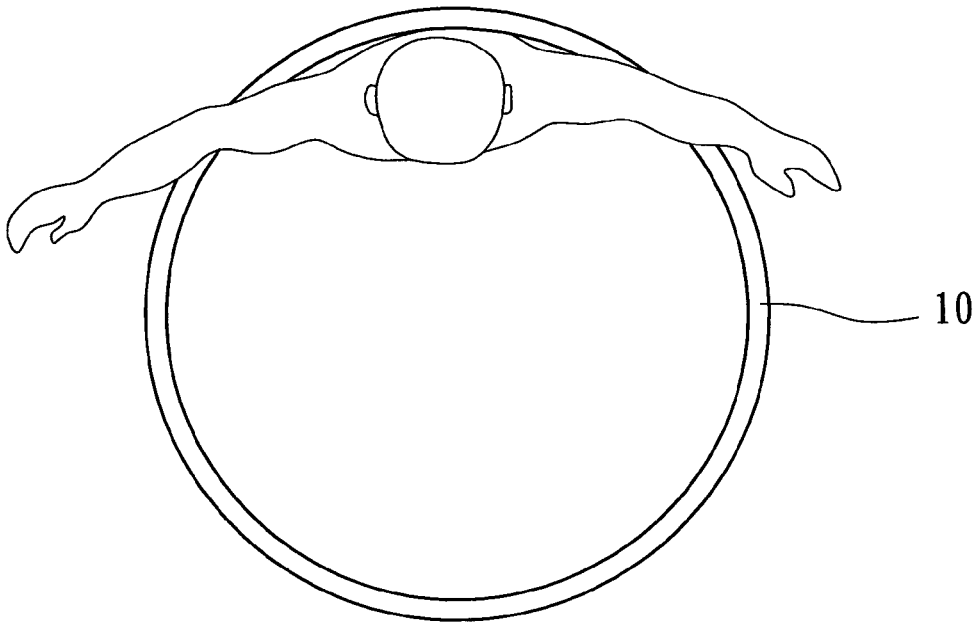
FIG. 1(PRIOR ART)
FIG. 1 is a schematic top view showing a using status of a hula-hoop according to the prior art.
Figure 2:
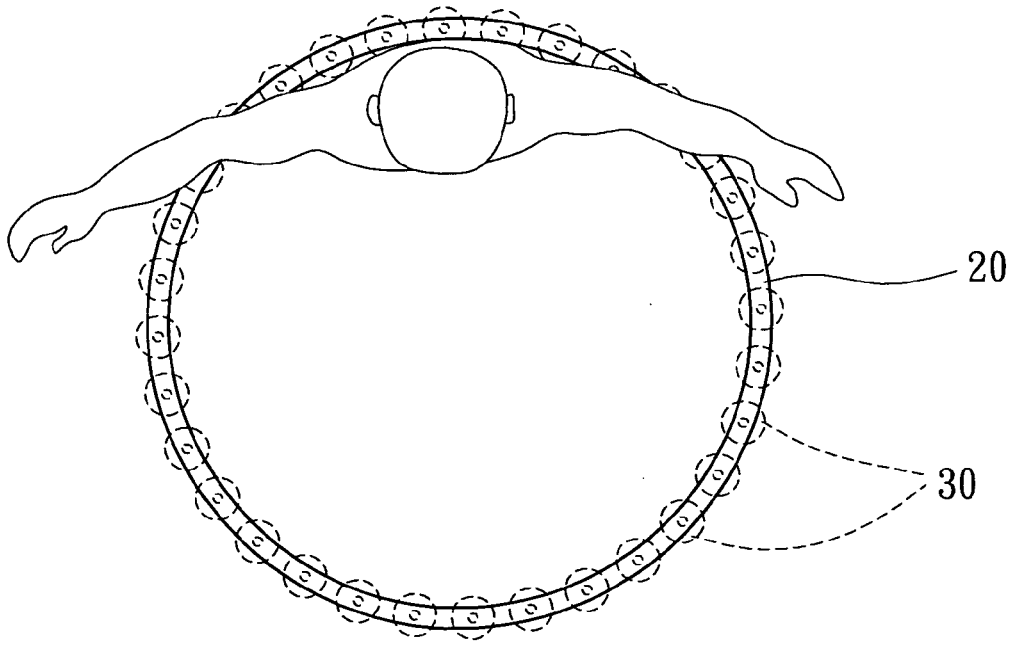
FIG. 2(PRIOR ART)
FIG. 2 is a schematic top view showing a using status of another structure of hula-hoop according to the prior art.
Figure 4:
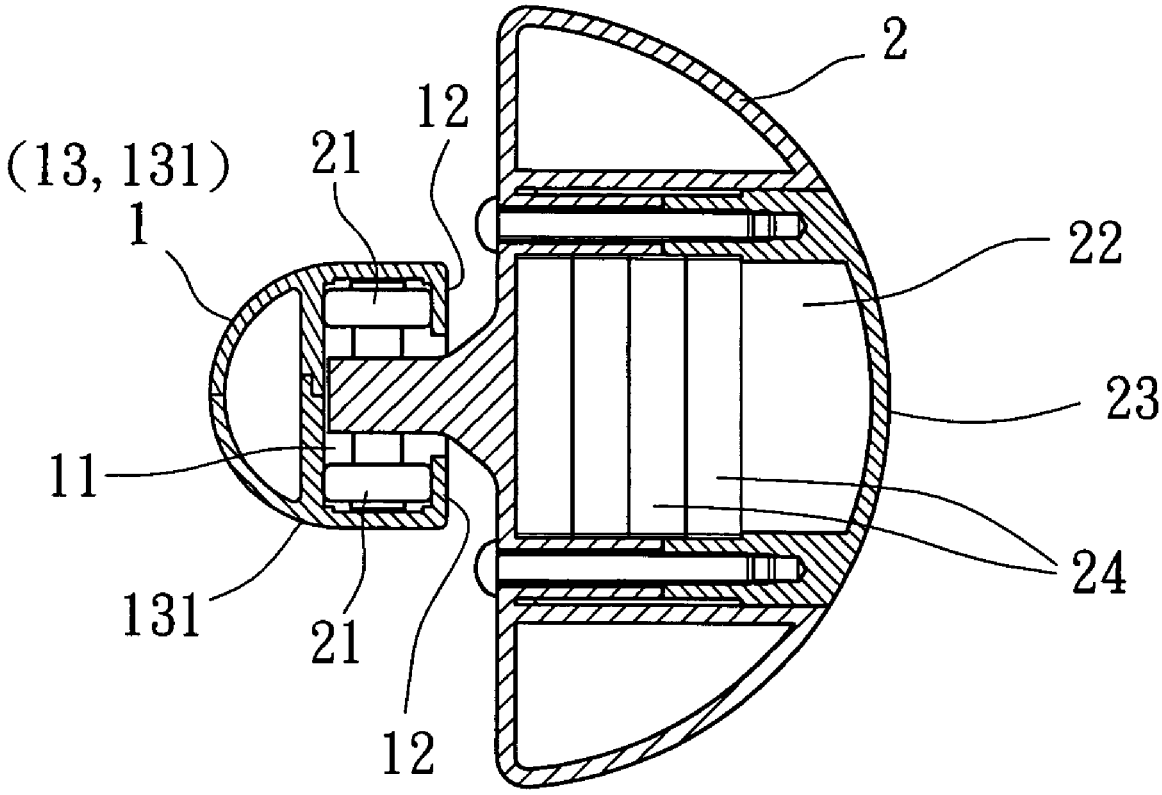
FIG. 4 is a sectional view in an enlarged scale taken along line A-A of FIG. 3.
Figure 5:
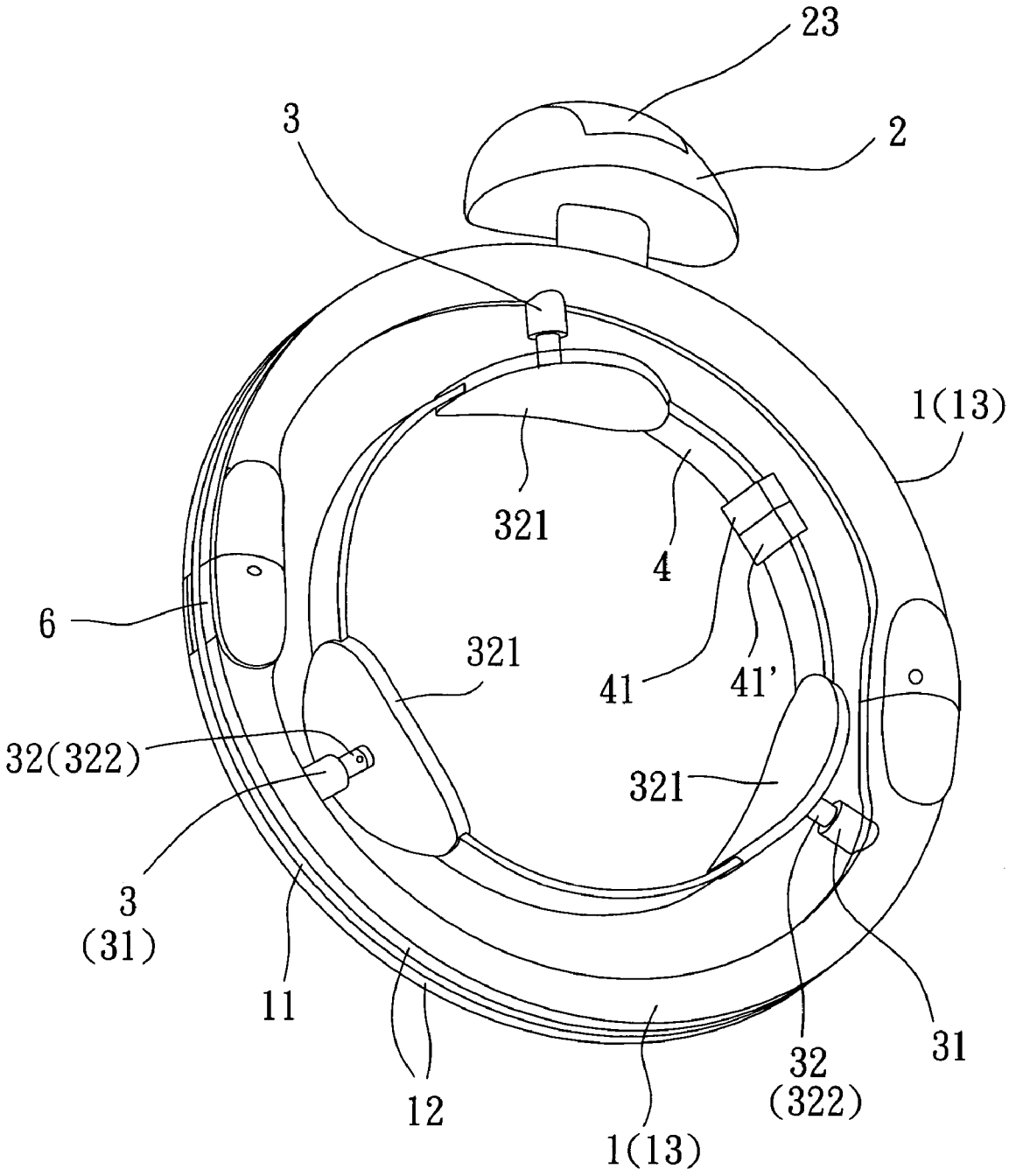
FIG. 5 is a perspective view of another alternate form of the hula-hoop according to the present invention.
Figure 6:
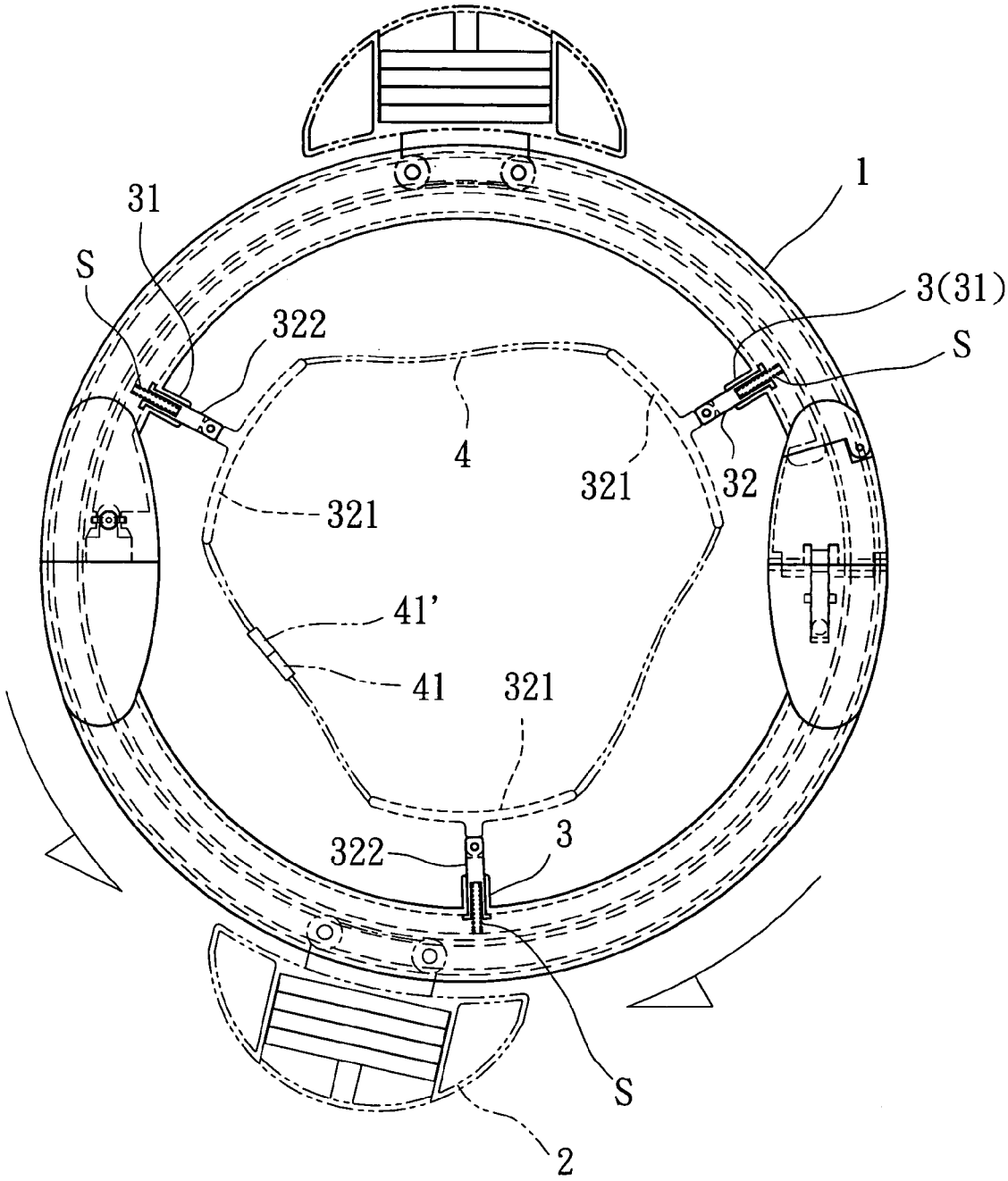
FIG. 6 is a plain view of the hula-hoop shown in FIG. 5.
Figure 7:
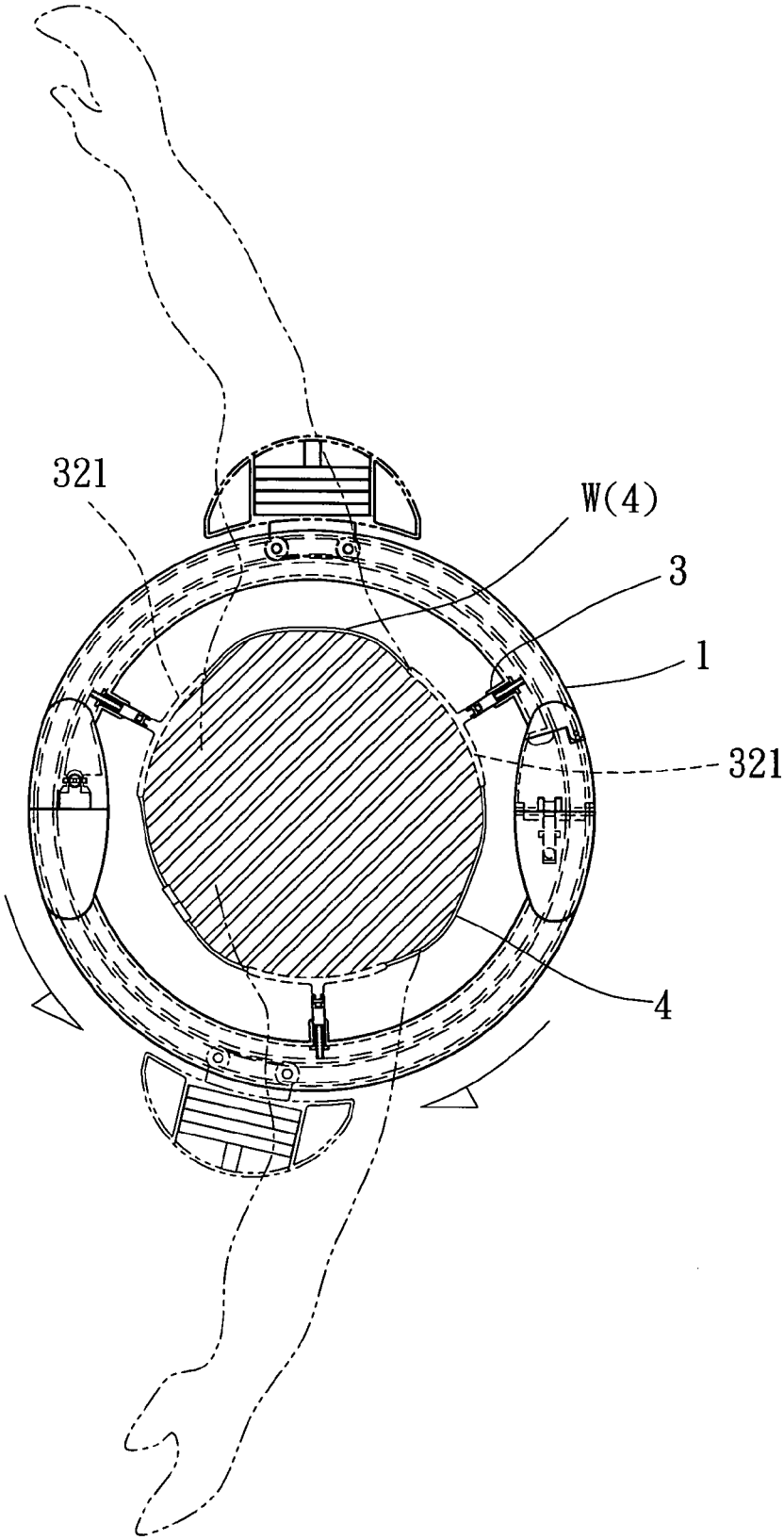
FIG. 7 is a schematic drawing showing an application example of the hula-hoop shown in FIG. 5.
Figure 9:
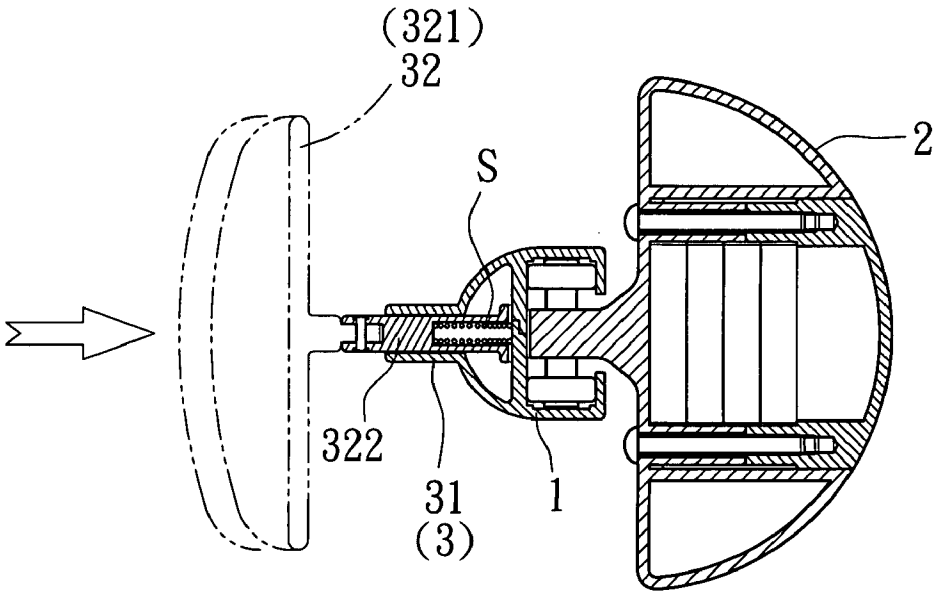
FIG. 9 is similar to FIG. 8 but showing the belt holder moved relative to the socket.
Figure 8:
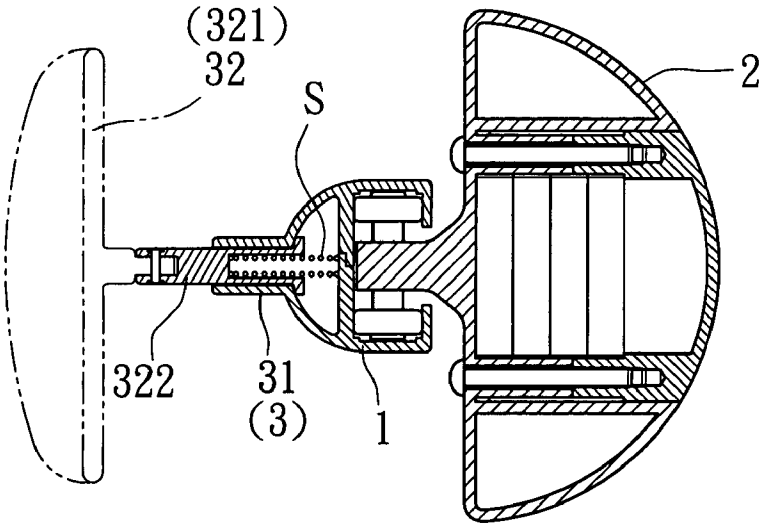
FIG. 8 is a schematic sectional view showing the connecting structure between the hula-hoop body and the sliding member according to the present invention.

Referring to FIGS. 3 and 4, a hula-hoop in accordance with one embodiment of the present invention is shown comprised of a hula-hoop body 1, which has an endless sliding groove 11 extending around the periphery, and a plurality of sliding members 2 respectively coupled to the hula-hoop body 1 and movable along the sliding groove 11. The hula-hoop body 1 further has stop flanges 12 provided at top and bottom sides of the sliding groove 11 to prevent disconnection of the sliding members 2 from the hula-hoop body 1. Each sliding member 2 has coupling portions 21 coupled to the sliding groove 11, an accommodating chamber 22 for selectively holding a number of weights 24, and a detachable cap 23 for closing the accommodating chamber 22.

In an alternate form of the present invention as shown in FIG. 3A, the hula-hoop body 1 has a sliding rail 11' extending around the periphery, and the sliding members 2 are respectively coupled to and movable along the sliding rail 11'.

Referring to FIGS. 5~9, a plurality of support members 3 equiangularly spaced around the inner diameter of the hula-hoop body 1 to hold a belt 4. Each support member 3 comprises a socket 31 fixedly provided at the hula-hoop body 1, a belt holder 32, which comprises a hollow holder body 321 adapted to hold the belt 4 around the user's waist W and a shank 322 downwardly extending from the bottom side of the holder body 321 and axially slidably coupled to the socket 31, and a spring member S mounted inside the socket 31 to support the belt holder 32. The belt 4 is inserted through the holder body 321 of each support member 3, having two ends respectively terminating in a male connector 41 and a female connector 41' that are detachably fastened together. Because the belt holders 32 of the support members 3 are respectively supported on the respective spring members S in the respective sockets 31, the belt holders 32 are radially movable to fit the waistline of different users.

Figure 10:
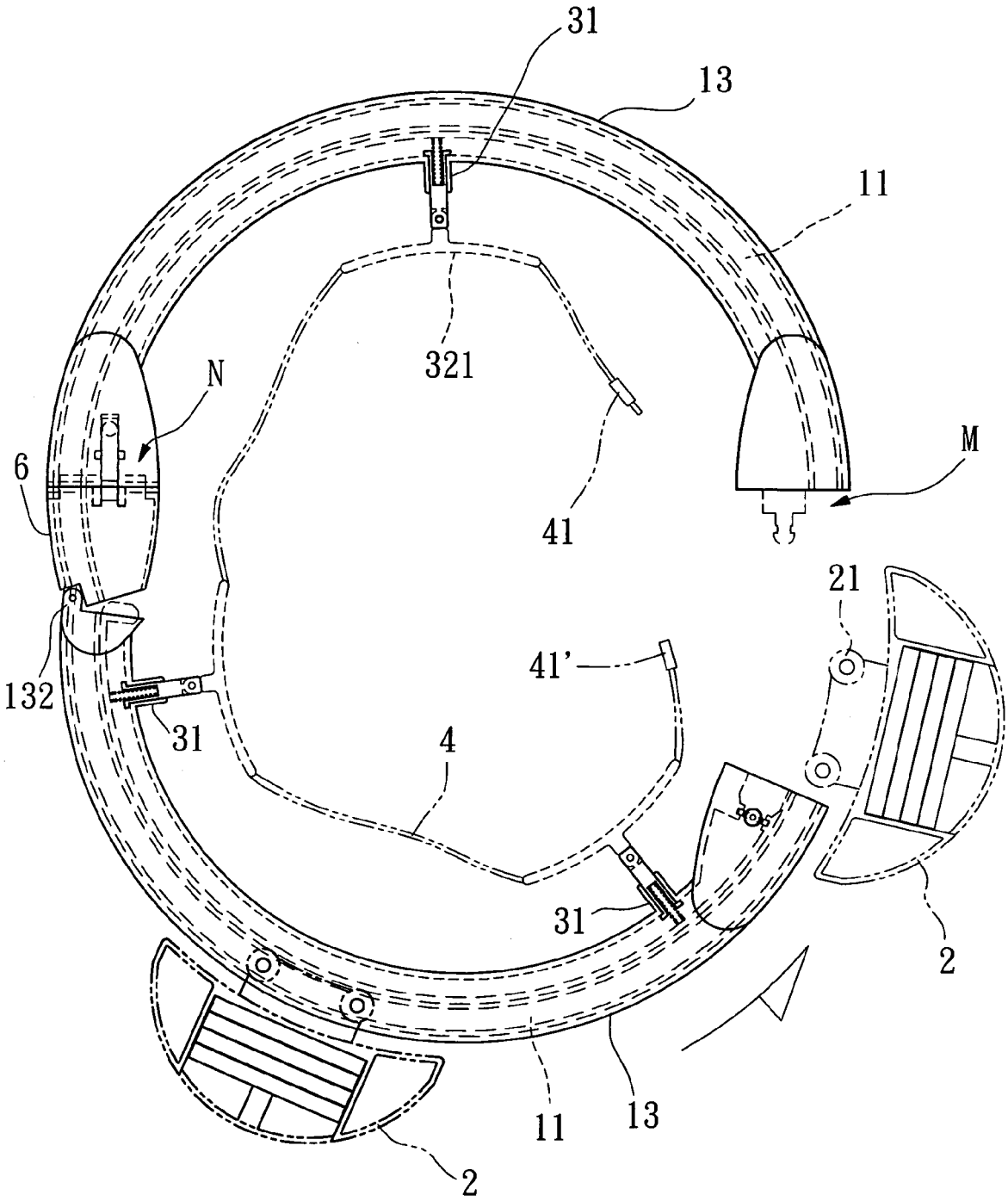
FIG. 10 is a schematic plain view showing the two semicircular haves of the hula-hoop body opened according to the present invention.
Figure 11:
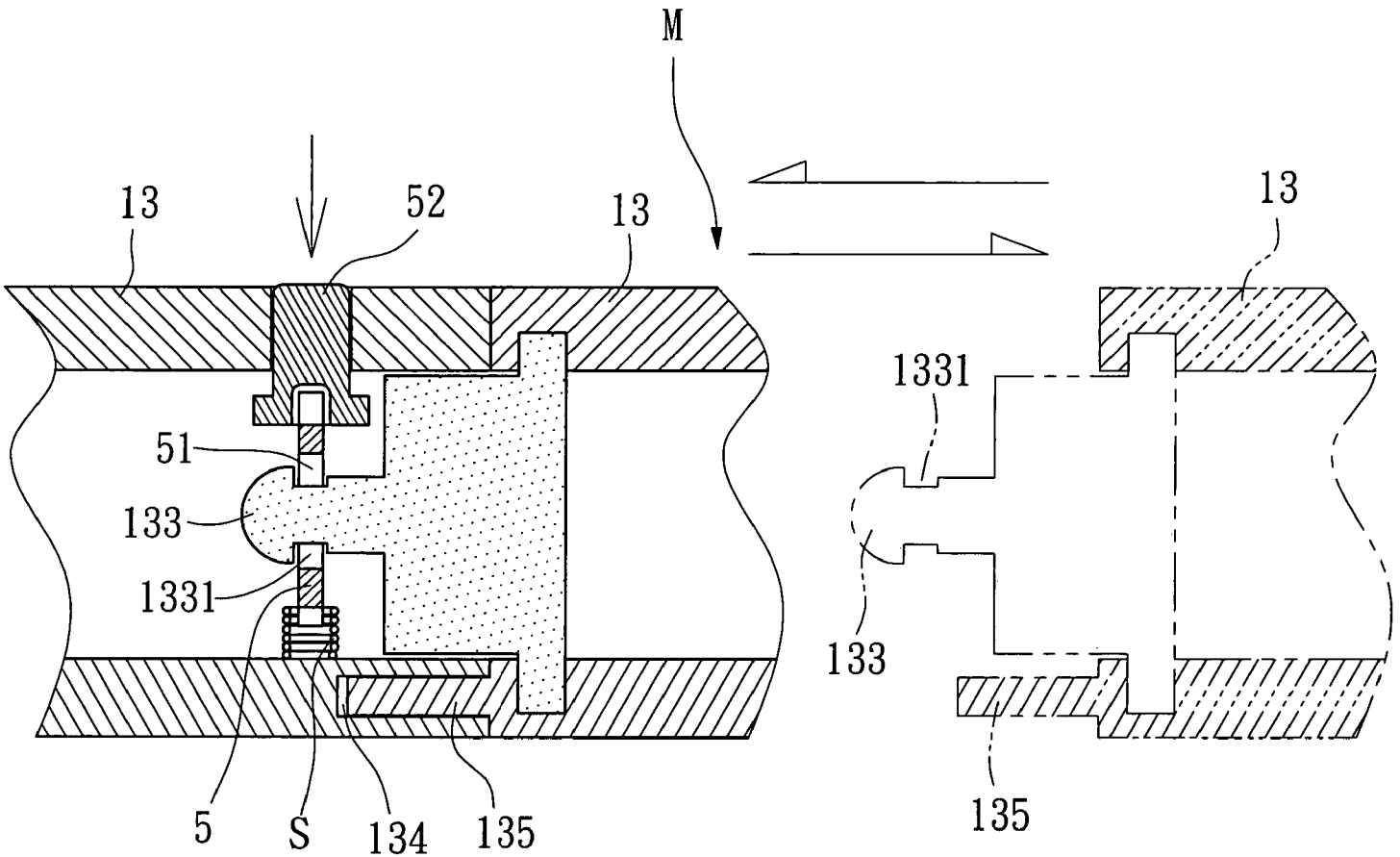
FIG. 11 is a schematic drawing showing the structure of the quick-release lock according to the present invention.
Figure 12:
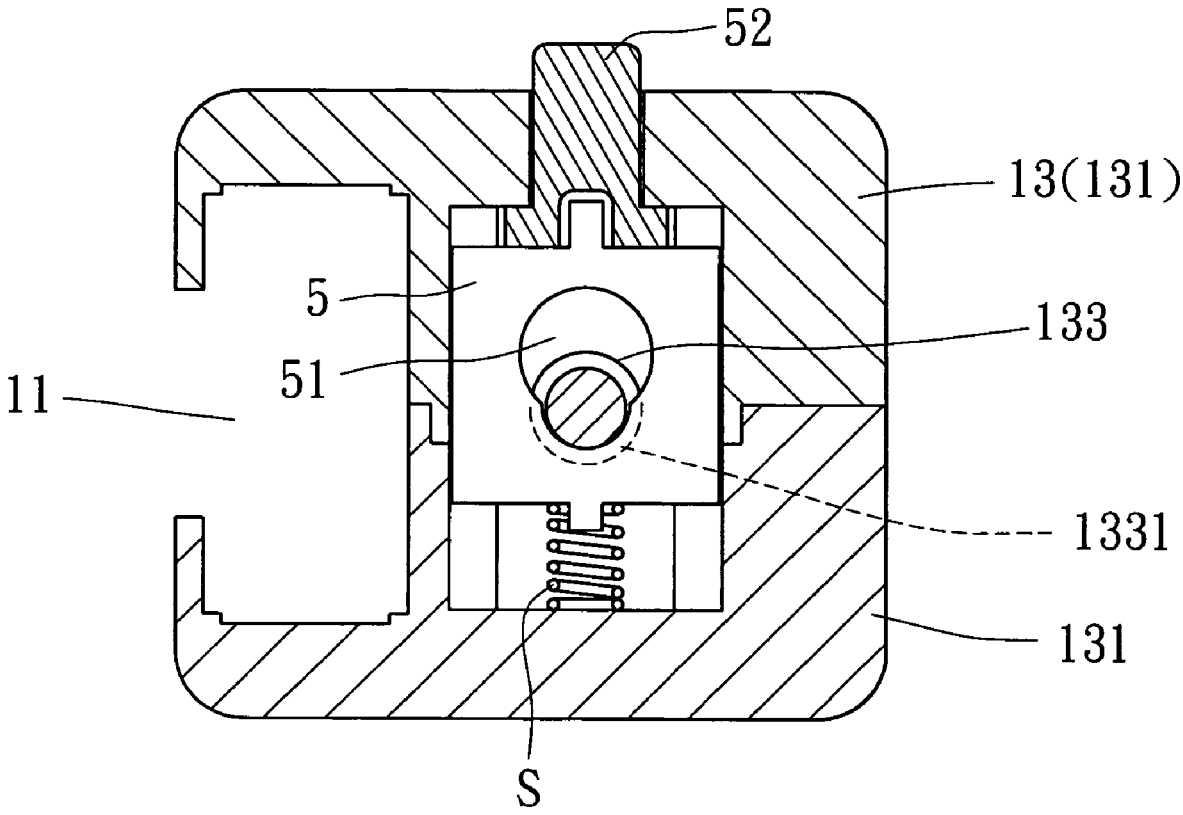
FIG. 12 is a schematic end view, showing the quick-release lock locked according to the present invention.
Figure 13:
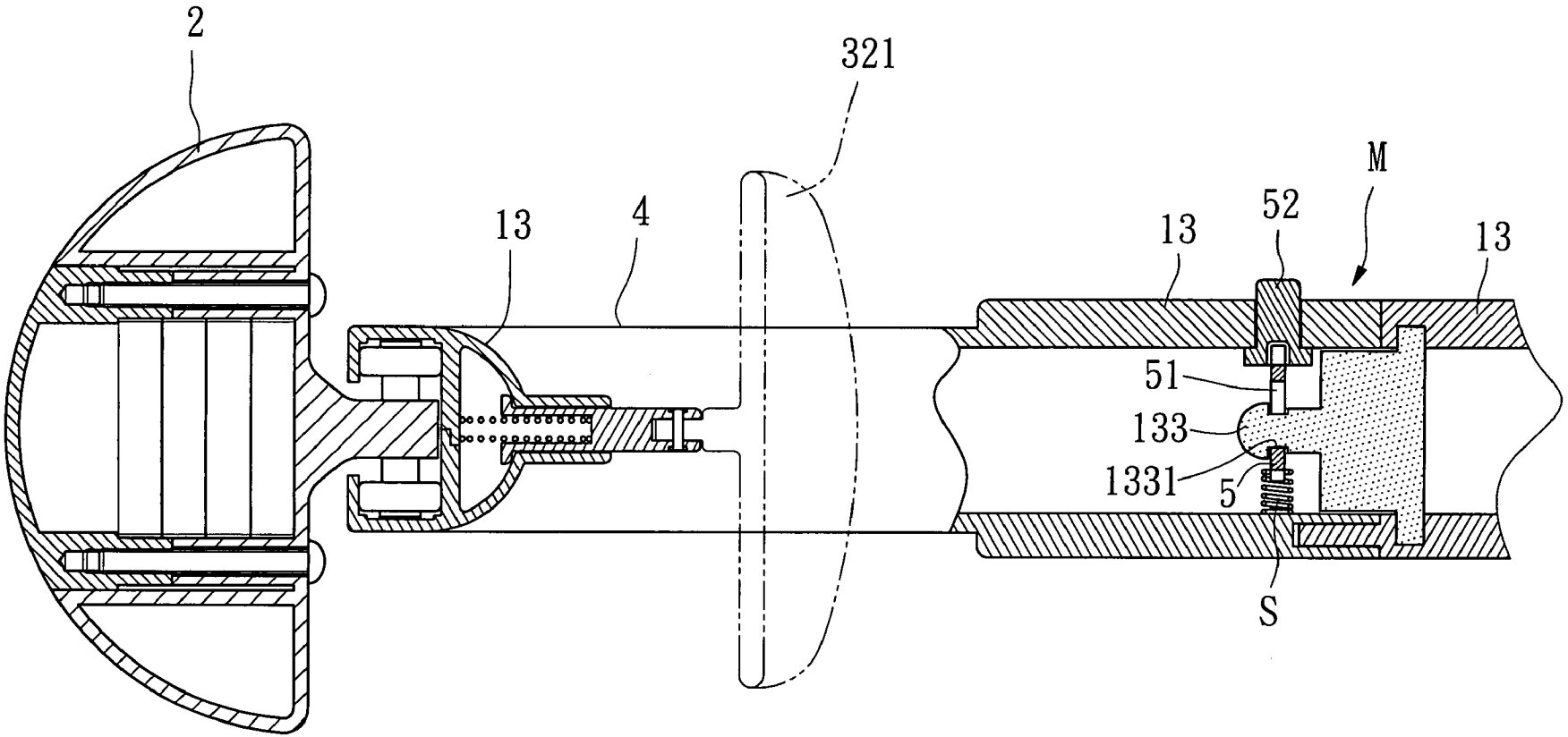
FIG. 13 is a schematic sectional side view showing the locking status of the quick-release lock according to the present invention.
Figure 14:
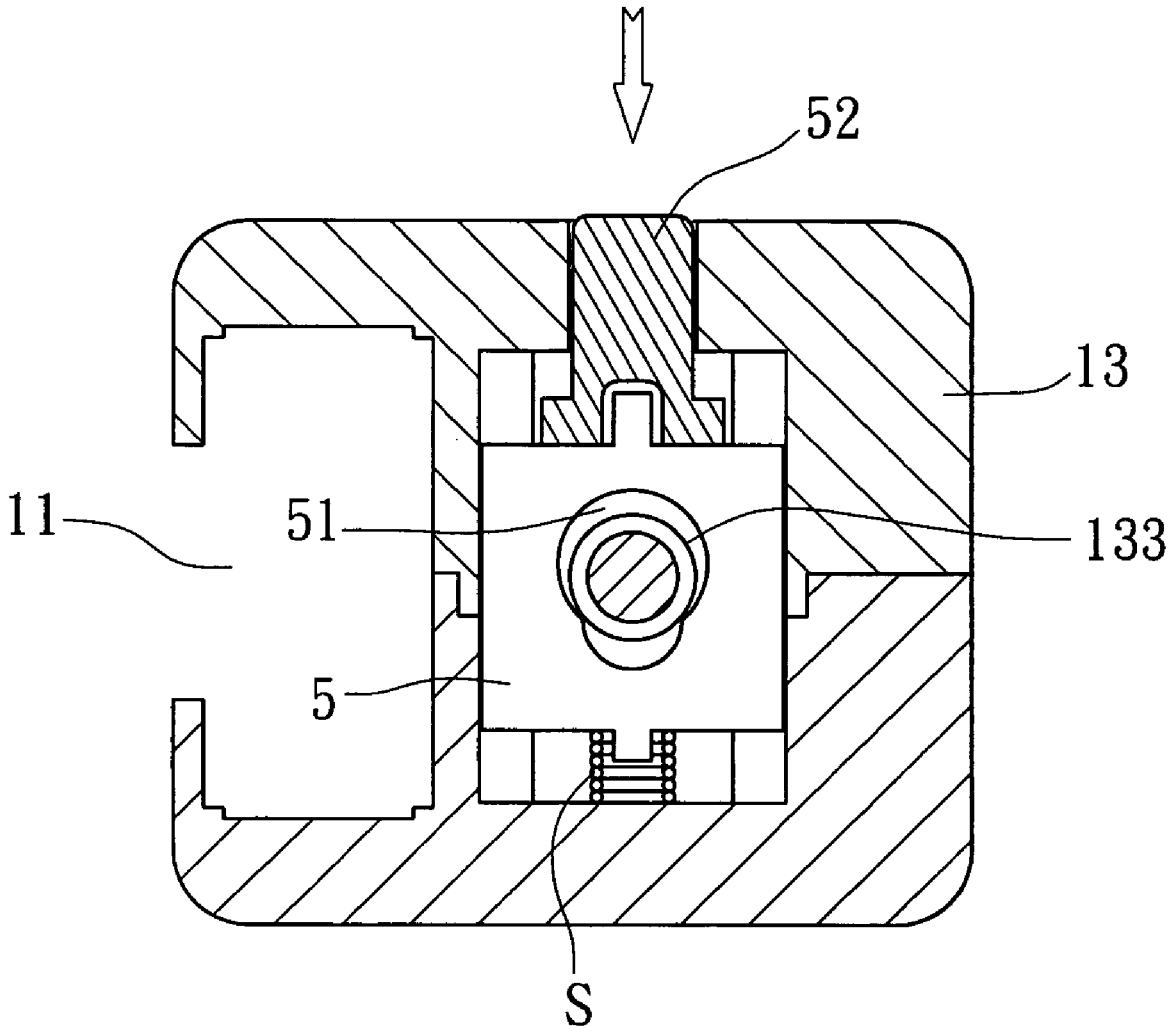
FIG. 14 is similar to FIG. 12 but showing the button pressed, the bolt disengaged from the retaining spring plate.

Referring to FIGS. 10~14 and FIGS. 3 and 4 again, the hula-hoop body 1 is comprised of two semicircular halves 13. Each semicircular half 13 is formed of two symmetrical elements 131 abutted against each other (see FIG. 4). The two semicircular halves 13 each have lugs 132 at one end, namely, the first end. The lugs 132 of the two semicircular halves 13 are pivotally connected together so that the two semicircular halves 13 can be opened as shown in FIG. 10 or closed as shown in FIG. 3. The two semicircular halves 13 each have the other end, namely, the second end respectively detachably connected to each other through a quick-release lock M. The quick-release lock M comprises a first lock part and a second lock part respectively provided at the two semicircular halves 13. The first lock part comprises a bolt 133, which has a neck 1331, and a plug rod 135. The second lock part comprises a plughole 135 adapted to receive the plug rod 135, a compression spring S, a button 52, and a retaining spring plate 5 connected between the compression spring S and the button 52. The retaining spring plate 5 has a retaining hole 51. When inserted the plug rod 135 into the plughole 134, the bolt 133 is forced through the retaining hole 51 of the retaining spring plate 5. At this time, the retaining spring plate 5 is elastically deformed for the passing of the bolt 133. After the bolt 133 has been inserted through the retaining hole 51, the retaining spring plate 5 immediately returns to its former shape to force the peripheral edge of the retaining hole 51 into engagement with the neck 1331 of the bolt 133, and therefore the two lock parts are fastened together, i.e., the quick-release lock M is locked. On the contrary, when pressed the button 52 to deform the retaining spring plate 5, the quick-release lock M is unlocked, and the user can move the two semicircular halves 13 apart.

Figure 15:
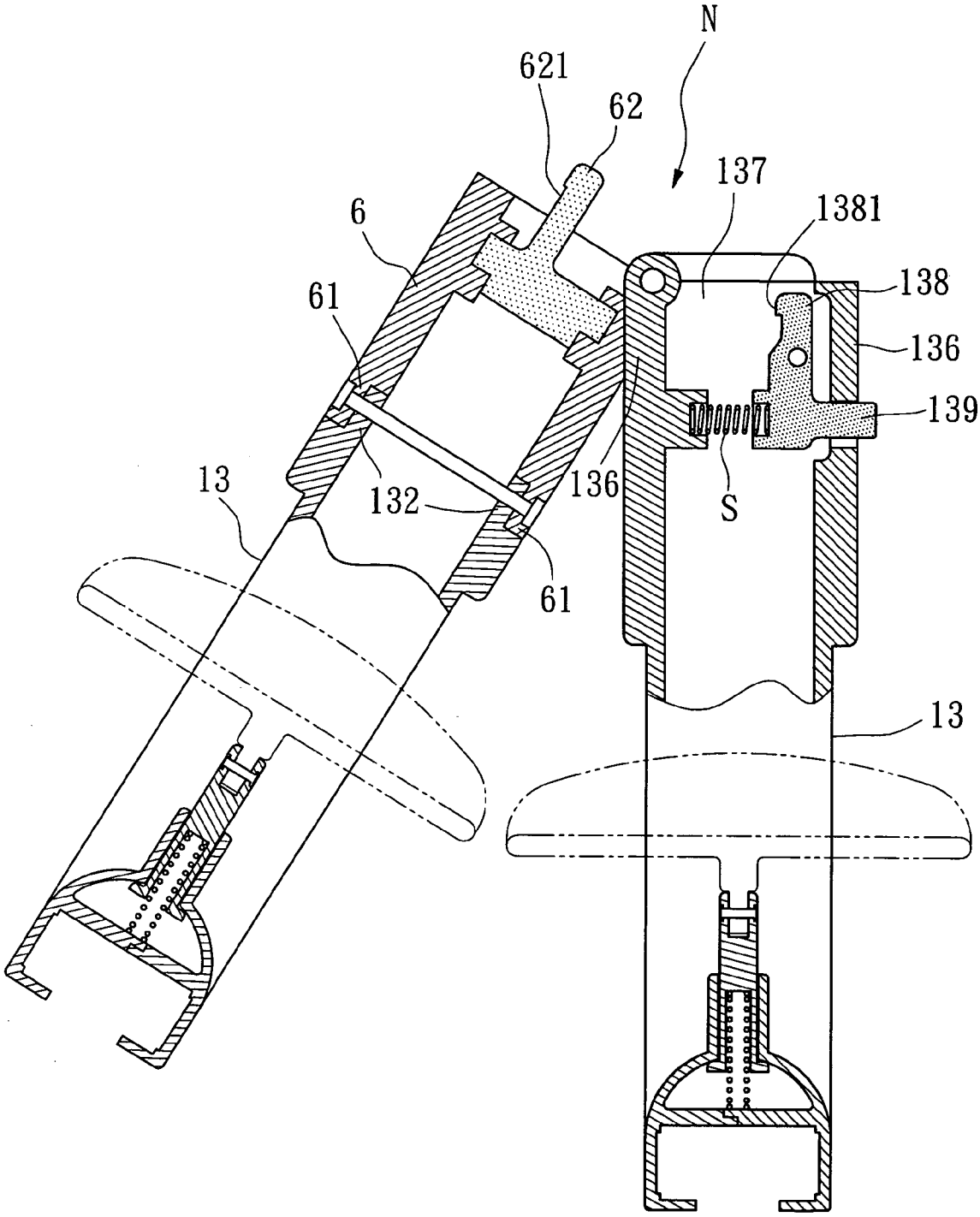
FIG. 15 is a schematic drawing showing the blocks at the first ends of the two semicircular halves of the hula-hoop body unlocked and turned away from each other.
Figure 16:
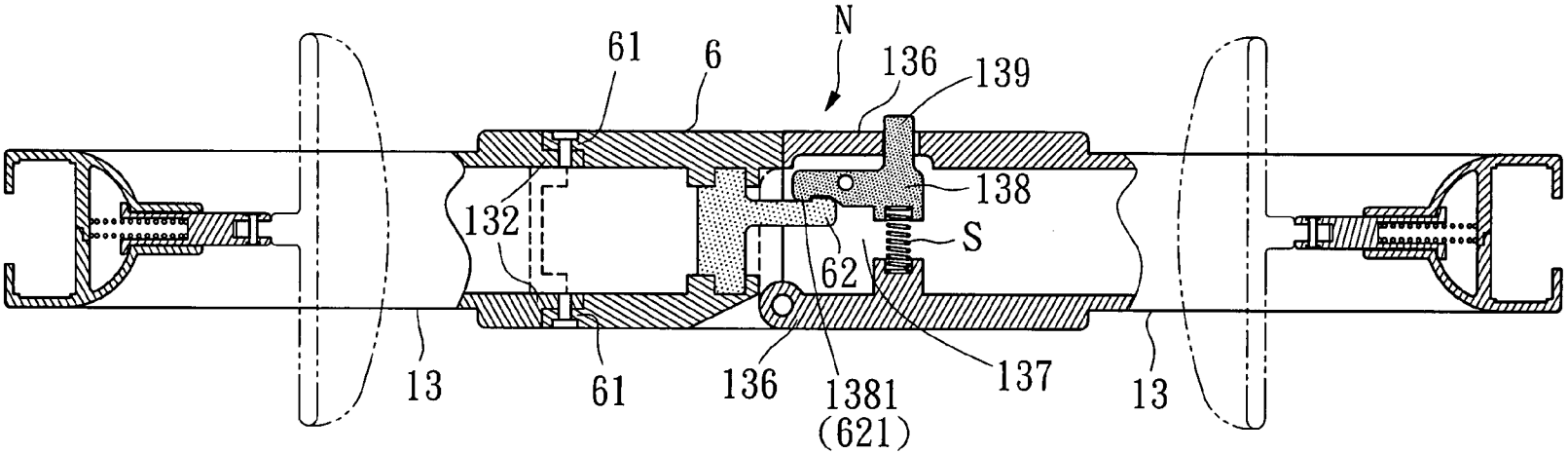
FIG. 16 is a schematic drawing showing the blocks at the first ends of the two semicircular halves of the hula-hoop body locked.
Figure 17:
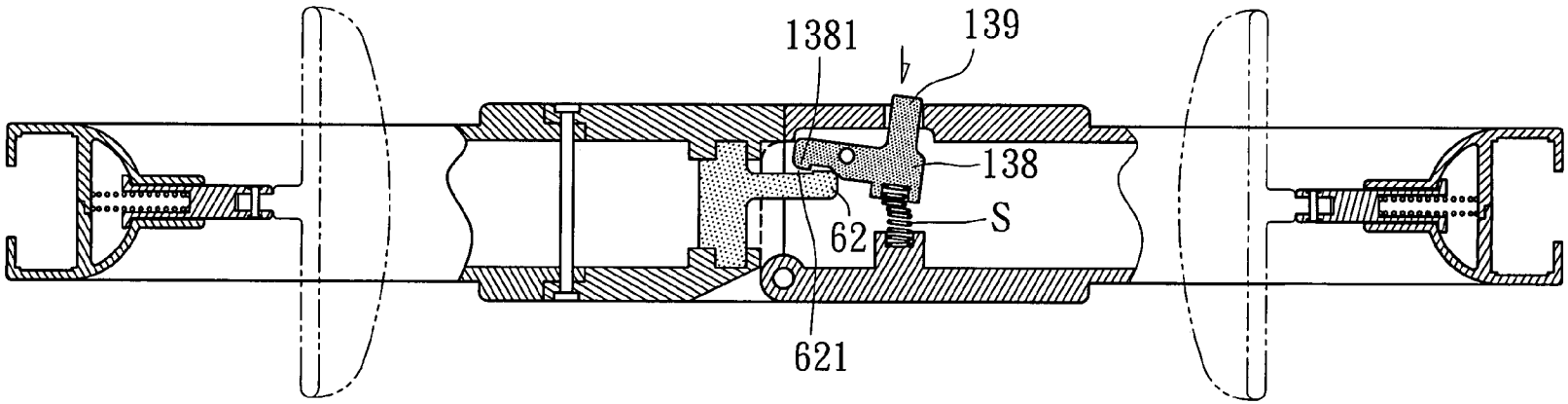
FIG. 17 is similar to FIG. 16 but showing the button pressed, the movable retaining rod disengaged from the fixed retaining rod.

Referring to FIGS. 15 and 16 and FIG. 10 again, the respective first ends of the two symmetrical halves 13 can be arranged in the form that one of the two symmetrical halves 13 has a block 6 pivotally connected to the lugs 132 thereof with a pivot pin 61, and the other of the two symmetrical halves 13 has the first end fixedly provided with a block 136 hinged to the block 6 and lockable by a lock N. The lock N comprises a fixed retaining rod 62, which is fixedly fastened to the block 6 and has a hooked portion 621, a compression spring 3 provided inside the block 136, a movable retaining rod 138, which is pivotally mounted inside the block 136 and has a rear end supported on the compression spring S and a front end terminating in a hooked portion 1381, and a button 139 formed integral with the rear end of the movable retaining rod 138 and extending to the outside of the block 136 opposite to the compression spring S. When the two blocks 6 and 136 are aligned and abutted against each other, the hooked portion 1381 of the movable retaining rod 138 is forced into engagement with the hooked portion 621 of the fixed retaining rod 62, and therefore the lock N is locked. On the contrary, when pressed the button 139 to bias the movable retaining rod 138 (see FIG. 17), the hooked portion 1381 of the movable retaining rod 138 is disengaged from the hooked portion 621 of the fixed retaining rod 62, and therefore the lock N is unlocked.

Figure 18:
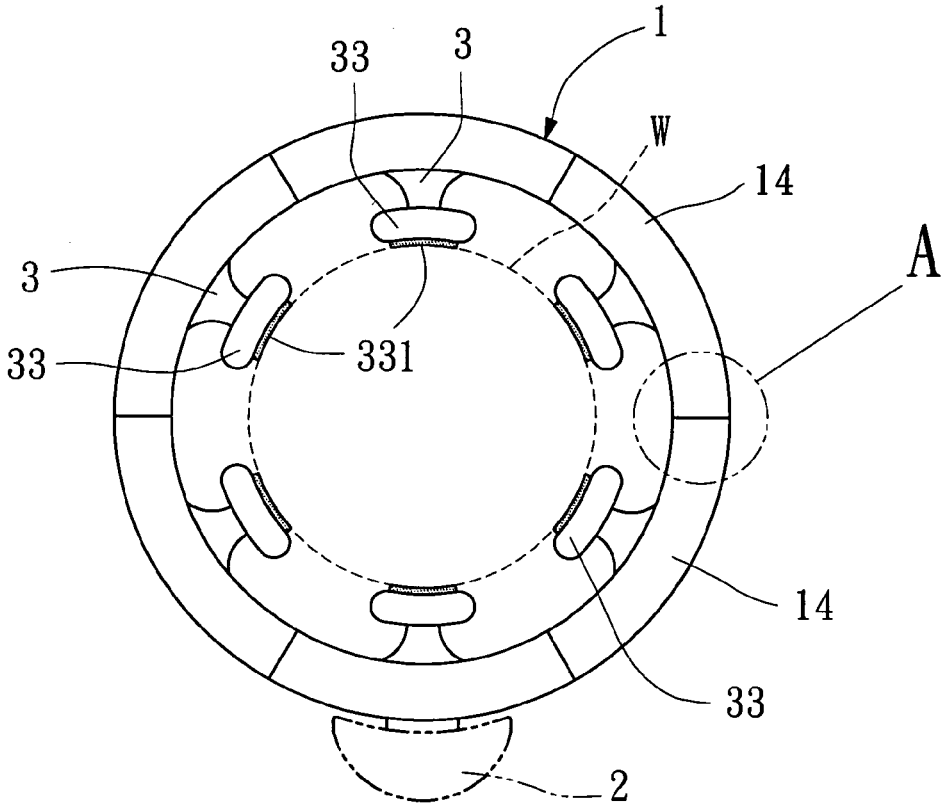
FIG. 18 is a top plain view of still another alternate form of the hula-hoop according to the present invention.
Figure 19:
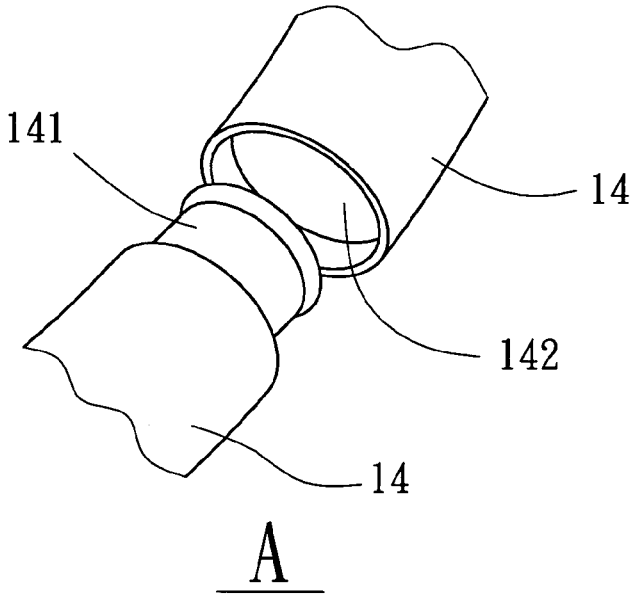
FIG. 19 is a sectional view in an enlarged scale of part A of FIG. 18.

Referring to FIGS. 18 and 19, the hula-hoop body 1 can be formed of a plurality of elements 14 connected to one another in series. The elements 14 each have a male coupling member, for example, a coupling rod 141 at one end, and a female coupling member, for example, coupling hole 142 at the other end. By plugging the coupling rod 141 of one element 14 to the coupling hole 142 of another, the elements 14 are connected to one another in series. Further, according to the embodiment shown in FIG. 18, the aforesaid belt 4 is eliminated, and the support members 3 each have a front bearing portion 33 covered with a soft pad 331 for supporting the hula-hoop around the user's body.

Figure 20:
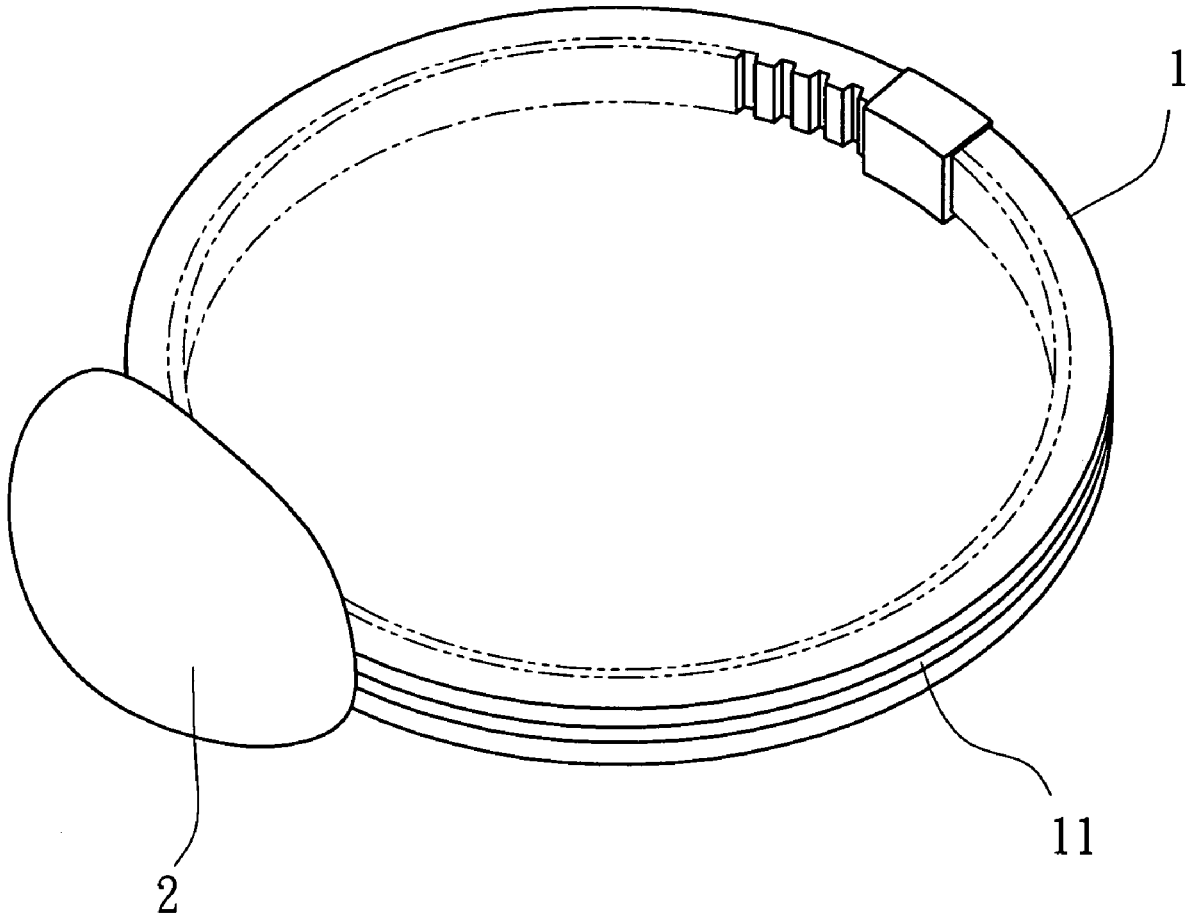
FIG. 20 is an elevational view of still another alternate form of the hula-hoop according to the present invention.

FIG. 20 shows a simple form of the hula-hoop according to the present invention. According to this embodiment, the hula-hoop comprises a hula-hoop body 1, which has a sliding groove 11 extending around the periphery, and one sliding member 2 coupled to the hula-hoop body 1 and movable along the sliding groove 11.

As indicated above, the present invention provides a hula-hoop, which comprises a hula-hoop body and at least one sliding member coupled to and movable along the periphery of the hula-hoop body. Each sliding member has an accommodating chamber adapted to accommodate weights. The hula-hoop body is comprised of two symmetrical halves that have one end pivotally connected to each other and the other end detachably connected to each other through a lock. When unlocked the lock, the two symmetrical halves of the hula-hoop body can be collapsed to reduce the storage dimension of the hula-hoop.

Although particular embodiments of the invention have been described in detail for purposes of illustration, various modifications and enhancements may be made without departing from the spirit and scope of the invention.

What the invention claimed is:

1. A hula-hoop comprising:

a hula-hoop body for swinging around the body of a person, said hula-hoop body having a sliding way extending around the periphery thereof, the periphery of said hula-hoop body having an inner diameter and an outer diameter; and at least one sliding member coupled to said hula-hoop body and movable along said sliding way;

wherein said hula-hoop body comprises a plurality of support members equiangularly spaced around the inner diameter thereof, and a belt fastened to said support members for swinging with said hula-hoop body around the body of a person; wherein each said support member comprises a socket fixedly provided at the inner diameter of said hula-hoop body, a belt holder, which comprises a hollow holder body adapted to hold said belt around and a shank downwardly extending from a bottom side of said holder body and axially slidably coupled to said socket, and a spring member mounted inside said socket and stopped against the shank of said belt holder.

2. The hula-hoop as claimed in claim 1, wherein said belt is inserted through the holder body of each said support member, having a male connector provided at a first end thereof, and a female connector provided at a second end thereof and connectable to said male connector.

3. A hula-hoop comprising:

a hula-hoop body for swinging around the body of a person, said hula-hoop body having a sliding way extending around the periphery thereof, the periphery of said hula-hoop body having an inner diameter and an outer diameter; and at least one sliding member coupled to said hula-hoop body and movable along said sliding way, said hula-hoop body being comprised of a first semicircular half and a second semicircular half coupled together;

wherein said first semicircular half and said second semicircular half each have a first end and a second end, the first ends of said first and second semicircular halves being pivotally coupled together, the second ends of said first and second semicircular halves being detachably connected together with a quick-release lock; and wherein said quick-release lock comprises a first lock part and a second lock part respectively provided at the second ends of said first and second semicircular halves, said first lock part comprising a bolt, which has a neck, said second lock part comprising a compression spring, a retaining spring plate supported on said compression spring, said retaining spring plate having a retaining hole adapted to receive said bolt, and a button connected to said retaining spring plate at one side opposite to said compression spring and extending to the outside of the second end of said second semicircular half for pressing by the user to elastically deform said retaining spring plate and to disengage said retaining hole from said bolt.

4. The hula-hoop as claimed in claim 3, wherein said first lock part further comprises a plughole; said second lock part further comprises a plug rod insertable into the plughole of said first lock part.

5. The hula-hoop as claimed in claim 3, wherein said hula-hoop body comprises a first block pivotally connected to the first end of said first semicircular half, a second block fixedly provided at the first end of said second semicircular half and hinged to said first block, and lock means adapted to lock said second block to said first block.

6. The hula-hoop as claimed in claim 5, wherein said lock means comprises a fixed retaining rod, which is fixedly fastened to said first block and has a hooked portion, a compression spring provided inside said second block, a movable retaining rod, which is pivotally mounted inside said second block and has a rear end supported on the compression spring inside said second block and a front end terminating in a hooked portion for hooking up with the hooked portion of said fixed retaining rod, and a button formed integral with the rear end of said movable retaining rod and extending to the outside of said second block opposite to the compression spring inside said second block for pressing by the user to bias said movable retaining rod and to disengage said movable retaining rod from said fixed retaining rod.

7. The hula-hoop as claimed in claim 3, wherein said hula-hoop body comprises a plurality of support members equiangularly spaced around the inner diameter thereof, said support members each having a front bearing portion covered with a soft pad for supporting the hula-hoop around the body of a person.

8. The hula-hoop as claimed in claim 7, wherein said hula-hoop body comprises a plurality of support members equiangularly spaced around the inner diameter thereof, and a belt fastened to said support members for swinging with said hula-hoop body around the body of a person.

9. The hula-hoop as claimed in claim 8, wherein said hula-hoop body comprises a plurality of support members equiangularly spaced around the inner diameter thereof, each said support member having a front bearing portion covered with a soft pad for supporting said hula-hoop body around the body of a person.

* * * * *